US006527627B2

(12) United States Patent
Arai

(10) Patent No.: US 6,527,627 B2
(45) Date of Patent: Mar. 4, 2003

(54) SEMICONDUCTOR WAFER GRINDING METHOD

(75) Inventor: Kazuhisa Arai, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 09/894,127

(22) Filed: Jun. 29, 2001

(65) Prior Publication Data

US 2002/0004359 A1 Jan. 10, 2002

(30) Foreign Application Priority Data

Jul. 4, 2000 (JP) ..... 2000-202661

(51) Int. Cl.[7] ..... B24B 1/00
(52) U.S. Cl. ..... 451/41; 451/57
(58) Field of Search ..... 451/41, 57, 65, 451/285, 287, 288, 398, 446

(56) References Cited

U.S. PATENT DOCUMENTS

| | | | | |
|---|---|---|---|---|
| 3,377,096 A | | 4/1968 | Wood | |
| 5,035,087 A | * | 7/1991 | Nishiguchi et al. | 451/11 |
| 5,567,199 A | * | 10/1996 | Huber et al. | 451/398 |
| 5,632,667 A | * | 5/1997 | Earl et al. | 451/41 |
| 5,816,895 A | * | 10/1998 | Honda | 451/41 |
| 5,827,111 A | * | 10/1998 | Ball | 451/14 |
| 6,080,046 A | * | 6/2000 | Shendon et al. | 451/54 |
| 6,095,899 A | * | 8/2000 | Elmar et al. | 451/28 |
| 6,159,071 A | * | 12/2000 | Koma et al. | 451/5 |
| 6,227,950 B1 | * | 5/2001 | Hempel et al. | 451/66 |

FOREIGN PATENT DOCUMENTS

| | | | | |
|---|---|---|---|---|
| DE | 196 41 534 | | 4/1998 | |
| EP | 0 897 778 | | 2/1999 | |
| EP | 0 926 706 | | 6/1999 | |
| JP | 2000-21820 | * | 1/2000 | B28D/5/00 |
| WO | WO 00 41854 | | 7/2000 | |

* cited by examiner

*Primary Examiner*—George Nguyen
*Assistant Examiner*—Dung Van Nguyen
(74) *Attorney, Agent, or Firm*—Smith, Gambrell & Russell, LLP

(57) ABSTRACT

A method of grinding a semiconductor using grinding machine having a chuck table for holding a semiconductor and a grinding means for grinding the top surface of a semiconductor placed on the chuck table, comprising the step of holding the ground semiconductor wafer carried out from the chuck table after grinding by means of a wafer holding tray.

3 Claims, 4 Drawing Sheets

SEMICONDUCTOR WAFER GRINDING METHOD

FIELD OF THE INVENTION

The present invention relates to a semiconductor wafer grinding method and, more specifically, to a method of grinding a semiconductor wafer using a grinding machine having a chuck table for holding a semiconductor wafer and a grinding means for grinding the top surface of the semiconductor wafer held on the chuck table.

DESCRIPTION OF THE PRIOR ART

As known to people having ordinary skill in the art, in a semiconductor device production process, a substantially disk-like semiconductor wafer is divided into pellets to form semiconductor chips. To improve the heat radiation properties of the semiconductor chip, the thickness of the semiconductor chip is desirably made as small as possible. To enable the downsizing of portable telephones, smart cards, personal computers and the like in which a large number of semiconductor chips are used, the semiconductor chip is desirably formed as thin as possible. To this end, before the semiconductor wafer is divided into pellets, the rear side of the semiconductor wafer is ground to machine it to have a predetermined thickness. In the grinding machine for grinding the back surface of a semiconductor wafer, the semiconductor wafer as a workpiece is suction-held on a chuck table, and the rear side (top surface) of the semiconductor wafer whose top surface is suction-held on the chuck tablet is ground by a grinding means.

When the semiconductor wafer is ground to a thickness of 100 m or less, for example, the rigidity thereof lowers and consequently, flexure occurs all over the semiconductor wafer, thereby making it difficult to carry it and store it in a cassette. In a production method so-called "pre-dicing" in which, before the rear side of the semiconductor wafer is ground, dicing grooves having a predetermined depth from the surface are formed by a dicing machine and then, the rear side of the semiconductor wafer is ground to a thickness of about 50 m to divide the semiconductor wafer into chips. Though the ground semiconductor wafer is not divided into chips by the function of a protective tape affixed to the front side of the semiconductor wafer, it does not have rigidity at all as a semiconductor wafer, thereby making it extremely difficult to carry and store it in a cassette after grinding.

To make it easy to carry the ground semiconductor wafer, the semiconductor wafer is bonded to a substrate having high rigidity, this substrate having the semiconductor wafer bonded thereto is placed on the chuck table, and the semiconductor wafer is ground so that the semiconductor wafer can be carried and can be stored in a cassette easily without occurrence of flexure due to the rigidity of the substrate even after the semiconductor wafer is made thin by grinding. However, in a grinding machine in which the finishing accuracy of the semiconductor wafer is determined by the surface accuracy of the chuck table and the grinding surface accuracy of the grinding means, the interposition of the substrate between the semiconductor wafer and the chuck table causes a reduction in finishing accuracy.

SUMMARY OF THE INVENTION

It is an object of the present invention to provide a semiconductor wafer grinding method which makes it possible to carry a ground semiconductor wafer smoothly without a reduction in finishing accuracy caused by grinding.

To attain the above object, according to the present invention, there is provided a method of grinding a semiconductor wafer using a grinding machine having a chuck table for holding a semiconductor wafer and a grinding means for grinding the top surface of a semiconductor wafer held on the chuck table, comprising:

- the step of placing the semiconductor wafer to be ground on the chuck table;
- the step of grinding the top surface of the semiconductor wafer placed on the chuck table to a predetermined thickness by means of the grinding means;
- the step of carrying out the ground semiconductor wafer from the chuck table; and
- the step of holding the ground semiconductor wafer carried out from the chuck table by means of a wafer holding tray.

The wafer holding tray for holding the above semiconductor wafer is constituted by an elastic pad which has innumerable voids formed in the surface and generates sucking force when negative pressure is produced by the voids crushed by restoring force generated by elasticity and adhesion and a substrate mounting the elastic pad and having communication holes for introducing negative pressure or applied pressure force into the elastic pad; and the above tray holding step is to place the semiconductor wafer carried out from the above chuck table on the surface of the elastic pad of the above wafer holding tray and introduce negative pressure into the communication holes to suction-hold the semiconductor wafer onto the elastic pad.

The above grinding machine has a cleaning means having a spinner table for placing the ground semiconductor wafer and a tray cassette for storing the above wafer holding tray; and the above tray holding step includes the sub-step of carrying out the wafer holding tray stored in the above tray cassette and placing it on the spinner table before the ground semiconductor wafer is placed on the spinner table, the sub-step of mounting the ground semiconductor wafer on the elastic pad of the wafer holding tray placed on the spinner table, and the sub-step of introducing negative pressure into the communication holes formed in the substrate of the wafer holding tray mounted on the spinner table to suction-hold the semiconductor wafer on the elastic pad.

The above grinding machine comprises a cassette for storing a ground semiconductor wafer after cleaning; and the above semiconductor wafer grinding method of the present invention further comprises the step of storing the semiconductor wafer integratedly held on the wafer holding tray in the above cassette from the cleaning means after the semiconductor wafer is cleaned with the above cleaning means.

BRIEF DESCRIPTION THE DRAWINGS

DETAILED DESCRIPTION OF THE PREFERRED EMBODIMENTS

Preferred embodiments of the semiconductor wafer grinding method of the present invention will be described in detail hereinafter with reference to the accompanying drawings.

Figure 1:
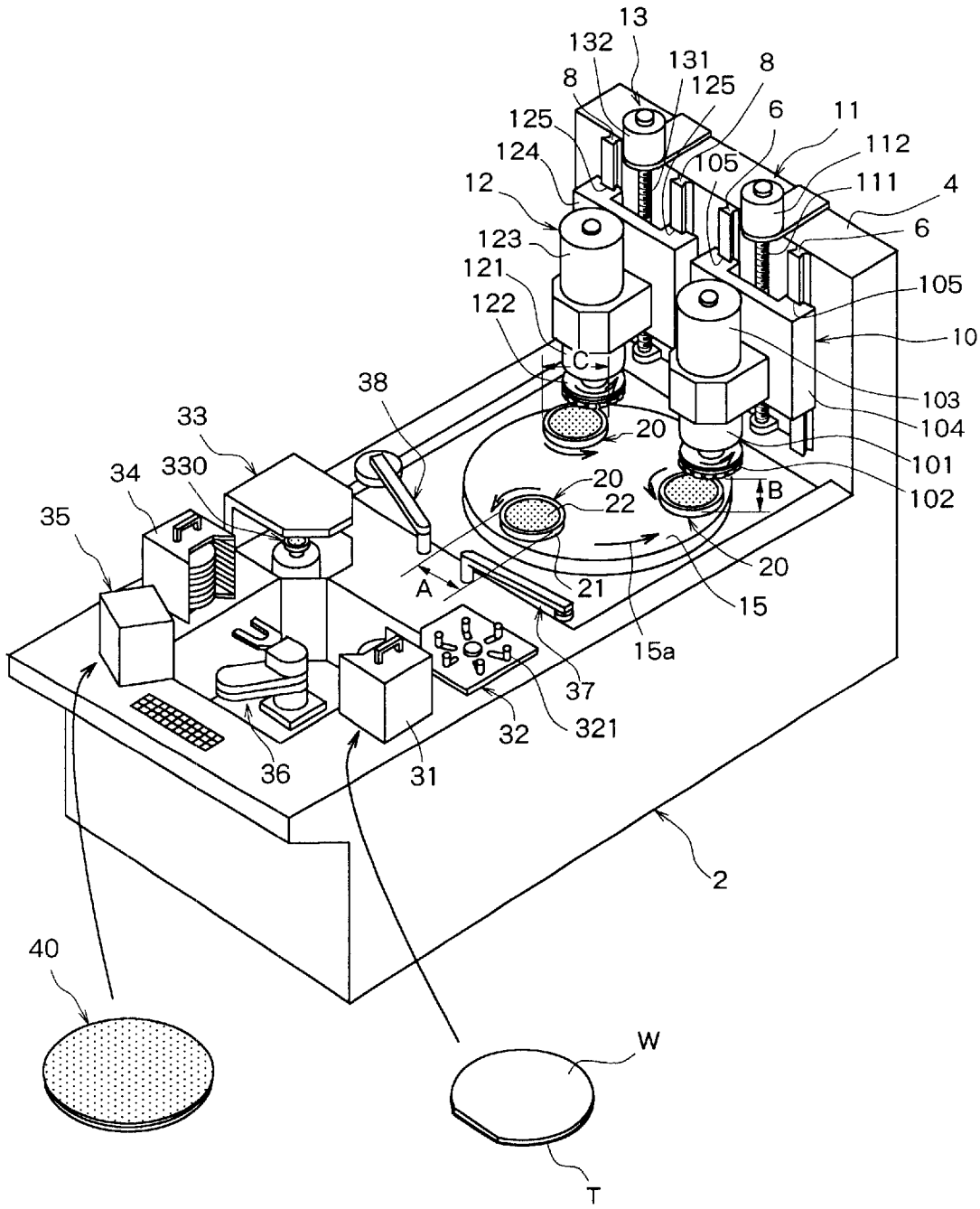
FIG. 1 is a perspective view of a grinding machine for carrying out the semiconductor wafer grinding method of the present invention.

FIG. 1 is a perspective view of a grinding machine for carrying out the semiconductor wafer grinding method of the present invention.

The grinding machine in the illustrated embodiment comprises a substantially rectangular parallelepiped housing 2. A static support plate 4 is provided upright at a right upper end of the housing 2 in FIG. 1. Two pairs of guide rails 6,6 and 8,8 extending in a vertical direction are provided. on the inner side wall of the static support plate 4. A rough-grinding unit 10 as a rough-grinding means is mounted to one pair of guide rails 6,6 in such a manner that it can move in a vertical direction, and a finish-grinding unit 12 as a finish-grinding means is mounted to the other pair of guide rails 8,8 in such a manner that it can move in a vertical direction.

The rough-grinding unit 10 comprises a unit housing 101, a grinding wheel 102 rotatably attached to the lower end of the unit housing 101, a rotary drive unit 103, mounted to the upper end of the unit housing 101, for turning the grinding wheel 102 in a direction indicated by an arrow, and a movable base 104 mounting the unit housing 101. To-be-guided rails 105,105 are provided on the movable base 104 and movably fitted to the guide rails 6,6 provided on the above static support plate 4 so that the rough-grinding unit 10 is supported in such a manner that it can move in a vertical direction. The rough-grinding unit 10 of the illustrated embodiment comprises a feeding unit 11 for moving the above movable base 104 along the guide rails 6,6 to adjust the cutting depth of the grinding wheel 102. The feeding unit 11 comprises a male screw rod 111 which is rotatably provided in a vertical direction in parallel to the guide rails 6,6 and supported to the above static support plate 4, a pulse motor 112 for driving the male screw rod 111 and a female screw block (not shown) mounted on the movable base 104 and screwed with the male screw rod 111. The male screw rod 111 is driven in a forward direction or reverse direction by the pulse motor 112 to move the rough-grinding unit 10 in a vertical direction.

The above finish-grinding unit 12 has the same constitution as that of the rough-grinding unit 10. That is, it comprises a unit housing 121, a grinding wheel 122 rotatably attached to the lower end of the unit housing 121, a rotary drive unit 123, mounted to the upper end of the unit housing 121, for turning the grinding wheel 122 in a direction indicated by an arrow, and a movable base 124 mounting the unit housing 121. To-be-guided rails 125 and 125 are provided on the movable base 124, and movably fitted to the guide rails 8,8 provided on the above static support plate 4 so that the finish-grinding unit 12 is supported in such a manner that it can move in a vertical direction. The finish-grinding unit 12 of the illustrated embodiment comprises a feeding unit 13 for moving the above movable base 124 along the guide rails 8,8 to adjust the cutting depth of the grinding wheel 122. The feeding unit 13 has substantially the same constitution as the above feeding means 11. That is, the feeding unit 13 comprises a male screw rod 131 which is rotatably provided in a vertical direction in parallel to the guide rails 8,8 and supported to the above static support plate 4, a pulse motor 132 for driving the male screw rod 131 and a female screw block (not shown) mounted on the movable base 124 and mated with the male screw rod 131. The male screw rod 131 is driven in a forward direction or reverse direction by the pulse motor 132 to move the finish-grinding unit 12 in a vertical direction.

The grinding machine of the illustrated embodiment comprises a turn table 15 which is disposed substantially flush with the top surface of the housing 2 on the front side of the above static support plate 4. This turn table 15 is formed like a disk having a relatively large diameter and appropriately turned in a direction indicated by an arrow 15*a* by a rotary drive unit that is not shown. In the illustrated embodiment, three chuck tables 20 are arranged each other at a phase angle of 120° rotatably on the horizontal plane on the turn table 15. This chuck table 20 consists of a disk-like base 21 having a circular depression whose top is open and a suction-holding chuck 22 which is formed of a porous ceramic board fitted in the depression formed in the base 21 and is turned in a direction indicated by an arrow by a rotary drive unit that is not shown. The chuck table 20 is connected to a suction means that is not shown. The three chuck tables 5 arranged on the turn table 15 constituted as described above are moved to a workpiece carrying-in/carrying-out area A, a rough-grinding area B, a finish-grinding area C and a workpiece carrying-in/carrying-out A sequentially by properly turning the turn table 15.

Figure 2:
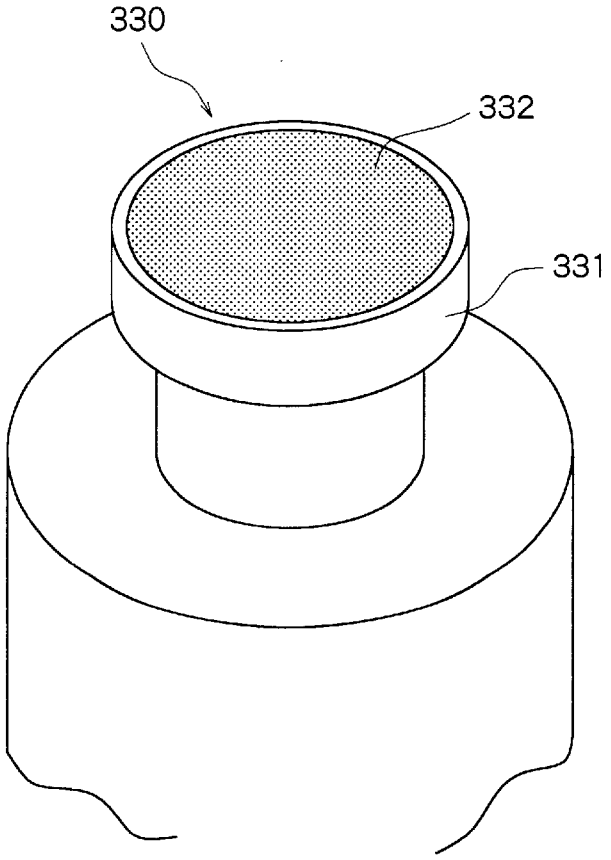
FIG. 2 is a perspective view of the essential section of a spinner table constituting a cleaning machine mounted to a surface grinding machine shown in FIG. 1.

A cassette 31 for storing a semiconductor wafer as a workpiece before grinding, and a workpiece placing unit 32 provided between the cassette 31 and the workpiece carrying-in/carrying-out area A are arranged on one side of the workpiece carrying-in/carrying-out area A in the illustrated grinding machine. The semiconductor wafer W whose under surface has been adhered to a tape T is stored in the cassette 31. A cleaning means 33 having a spinner table 330 for cleaning the semiconductor wafer after grinding is arranged on the other side of the workpiece carrying-in/carrying-out area A in the grinding machine. As shown in FIG. 2, the spinner table 330 of the cleaning means 33 consists of a disk-like base 331 having a circular depression whose top is open and a suction-holding chuck 332 formed of a porous ceramic board fitted in the depression formed in the base 331 and is connected to an air suction means that is not shown. A cassette 34 for storing a semiconductor wafer W as a ground workpiece cleaned by the cleaning means 33 and a tray cassette 35 for storing a wafer holding tray 40 to be described later for holding the ground semiconductor wafer W are also arranged on the other side of the workpiece carrying-in/carrying-out area A in the grinding machine. The grinding machine in the illustrated embodiment further comprises a workpiece carrying means 36 for carrying a semiconductor wafer W as a workpiece stored in the cassette 31 to the workpiece placing unit 32 and carrying a semiconductor wafer W cleaned by the cleaning means 33 to the cassette 34 after grinding. This workpiece carrying means 36 also has the function of carrying the later described wafer holding tray 40 stored in the cassette 35 to the top of the spinner table 330 of the above cleaning means 33. The grinding machine in the illustrated embodiment further comprises a workpiece take-in means 37 for carrying a semiconductor wafer W placed on the workpiece placing unit 32 to the top surface of the chuck table 20 positioned in the workpiece carrying-in/carrying-out area A and a workpiece take-out means 38 for carrying the ground semiconductor wafer W placed on the chuck table 20 positioned in the workpiece carrying-in/carrying-out area A to the cleaning means 33.

Figure 3:
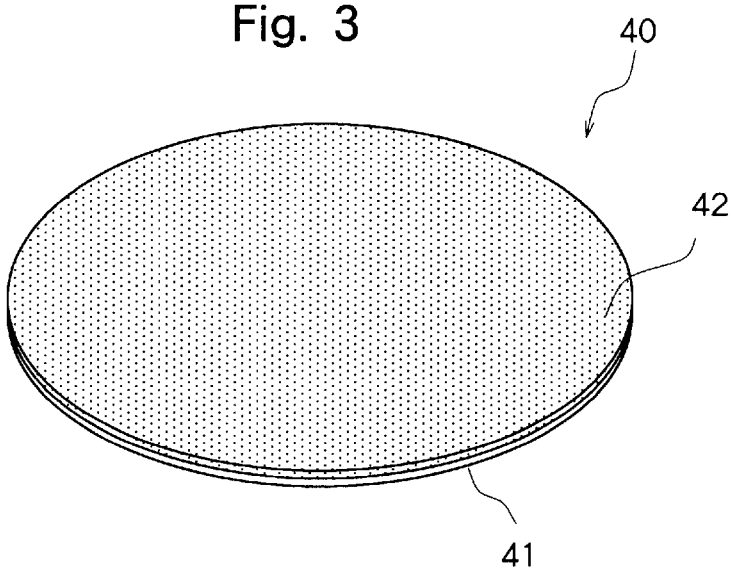
FIG. 3 is a perspective view of a wafer holding tray prepared for carrying out the semiconductor wafer grinding method of the present invention.
Figure 4:
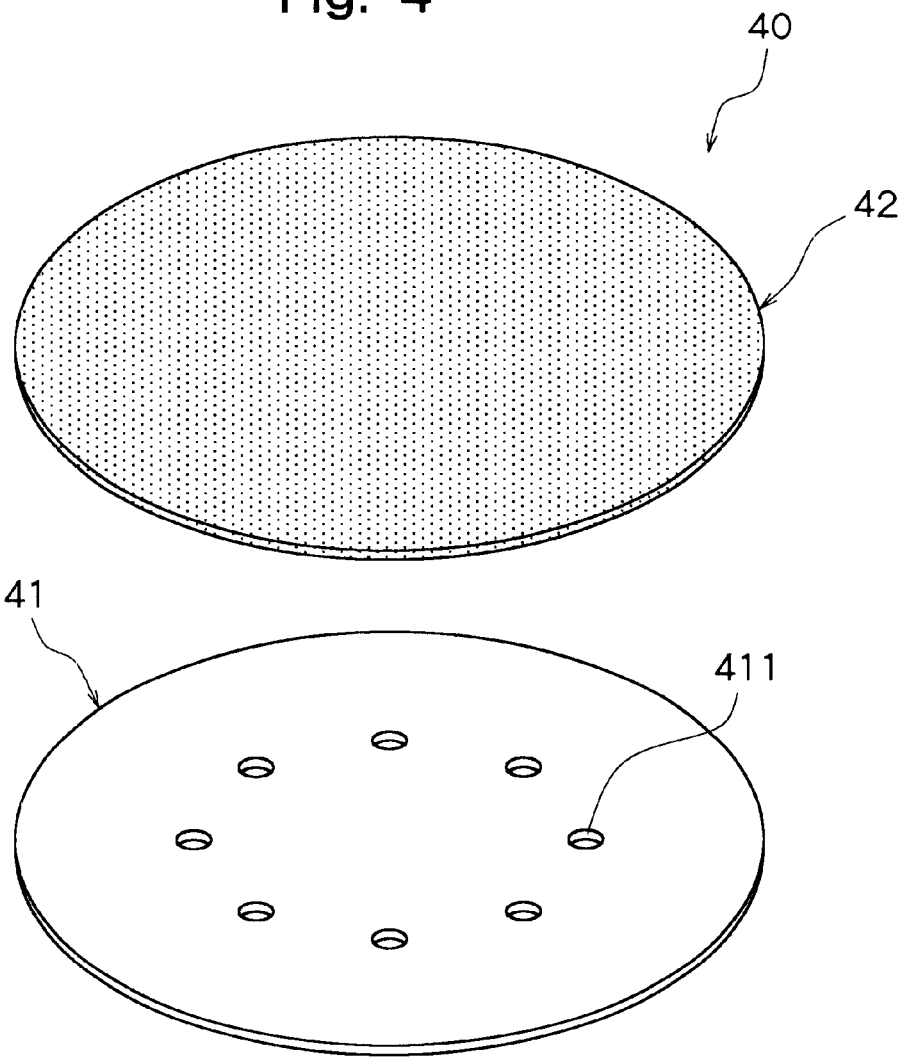
FIG. 4 is an exploded perspective view of the constituent members of the wafer holding tray shown in FIG. 3.
Figure 5:
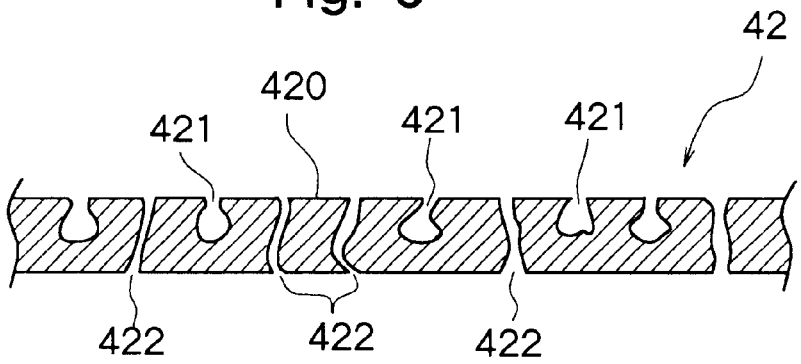
FIG. 5 is an enlarged sectional view of an elastic pad constituting the wafer holding tray shown in FIG. 3.

The wafer holding tray 40 for holding the ground semiconductor wafer will be described with reference to FIGS. 3 to 5.

The wafer holding tray 40 comprises a circular substrate 41 and a circular elastic pad 42 mounted on the top surface of the substrate 41. The substrate 41 is made from a hard material such as aluminum or synthetic resin and has a thickness of about 1 mm so that it does not bend easily. The thus formed substrate 41 has a plurality of communication holes 411 formed therethrough. Although the substrate 41 is formed circular in the illustrated embodiment, it is desirably conformed to the shape of the workpiece.

The above elastic pad 42 is made from a material having elasticity such as a synthetic resin exemplified by alkylbenzenesulfonic acid and conformed to the shape of the substrate 41. The thus formed elastic pad 42 has innumerable voids 421 formed at least in the surface 420 as shown in the enlarged view of FIG. 5. Through holes 422 as wide as several tens of micrometers extending through the elastic pad 42 are formed between adjacent voids 421 so that air can be circulated through the through holes 422. The thickness of the elastic pad 42 is determined in consideration of the properties of the workpiece but it is preferably about 0.5 mm. The elastic pad 42 is supplied by Dars Bond Co., Ltd., for example.

The elastic pad 42 constituted as described above is bonded to the top surface of the above substrate 41 with an appropriate adhesive to constitute the wafer holding tray 40 consisting of the substrate 41 and the elastic pad 42 integrated with each other. When the semiconductor wafer W is placed on the top surface of the elastic pad 42 and negative pressure is introduced through the communication holes 411 formed in the substrate 41, the negative pressure is applied to the semiconductor wafer W mounted on the top surface of the elastic pad 42 through the through holes 422 formed in the elastic pad 42 to adsorb the semiconductor wafer W to the elastic pad 42. At this point, the elastic pad 42 is compressed and the voids 421 formed in the surface 420 are crushed. As a result, even when the introduction of negative pressure through the communication holes 411 formed in the substrate 41 is released, negative pressure is produced in the voids 421 by restoring force generated by the elasticity of the elastic pad 42 and the adhesion of the elastic pad 42 and maintains the adsorption state of the semiconductor wafer W as suction force.

The grinding machine and the wafer holding tray in the illustrated embodiment are constituted as described above and the procedure of grinding work therewith will be described hereinafter.

The semiconductor wafer W as a workpiece before grinding stored in the cassette 31 is carried and placed on the workpiece placing unit 32 by the vertical and horizontal movements of the workpiece carrying means 36. The semiconductor wafer W before grinding placed on the workpiece placing unit 32 is centered by the radial movement toward the center of the six pins 321. The centered semiconductor wafer W on the workpiece placing unit 32 is placed on the chuck table 20 positioned in the workpiece carrying-in/carrying-out area A by the turning movement of the workpiece take-in means 37 (wafer placing step before grinding). When the semiconductor wafer W before grinding is placed on the chuck table 20, it can be suction-held on the suction-holding chuck 22 by activating a suction means that is not shown. By turning the turn table 15 in the direction indicated by the arrow 15*a* by a rotary drive unit that is not shown, the chuck table 20 on which the semiconductor wafer W before grinding is placed is positioned to the rough-grinding area B.

When the chuck table 20 on which the semiconductor wafer W before grinding has been placed is positioned in the rough-grinding area B, it is turned in the direction indicated by the arrow by the rotary drive unit that is not shown, and the grinding wheel 102 of the rough-grinding unit 10 is turned in the direction indicated by the arrow and lowered a predetermined amount by the feeding unit 11 to roughly grind the semiconductor wafer W before grinding on the chuck table 20 (wafer rough-grinding step). A semiconductor wafer W before grinding is placed on the next chuck table 20 positioned in the workpiece carrying-in/carrying-out area A during this as described above. Thereafter, the turn table 15 is turned at 120° in the direction indicated by the arrow 15*a* to position the chuck table 20, on which the rough-ground semiconductor wafer W has been placed, to the finish-grinding area C. At this point, the next chuck table 20 mounting the semiconductor wafer W before grinding in the workpiece carrying-in/carrying-out area A is positioned in the rough-grinding area B and a chuck table 20 after the next is positioned in the workpiece carrying-in/carrying-out area A.

The semiconductor wafer W before rough-grinding placed on the chuck table 20 positioned in the rough-grinding area B is roughly ground by the rough-grinding unit 10, and the roughly ground semiconductor wafer W placed on the chuck table 20 positioned in the finish-grinding area C is finish ground by the finish-grinding unit 12 (wafer finish-grinding step). Since the semiconductor wafer W is directly placed on the chuck table 20 in the above-described rough-grinding step and finish-grinding step, the finishing accuracy is not reduced. Subsequently, the turn table 15 is turned at 120° in the direction indicated by the arrow 15*a* to position the chuck table 20 mounting the finish ground semiconductor wafer W in the workpiece carrying-in/carrying-out area A. The chuck table 20 on which the roughly ground semiconductor W has been placed in the rough-grinding area B is moved to the finish-grinding area B and the chuck table 20 on which the semiconductor wafer W before grinding has been placed in the workpiece carrying-in/carrying-out area A is moved to the rough-grinding area B, respectively.

Figure 6:
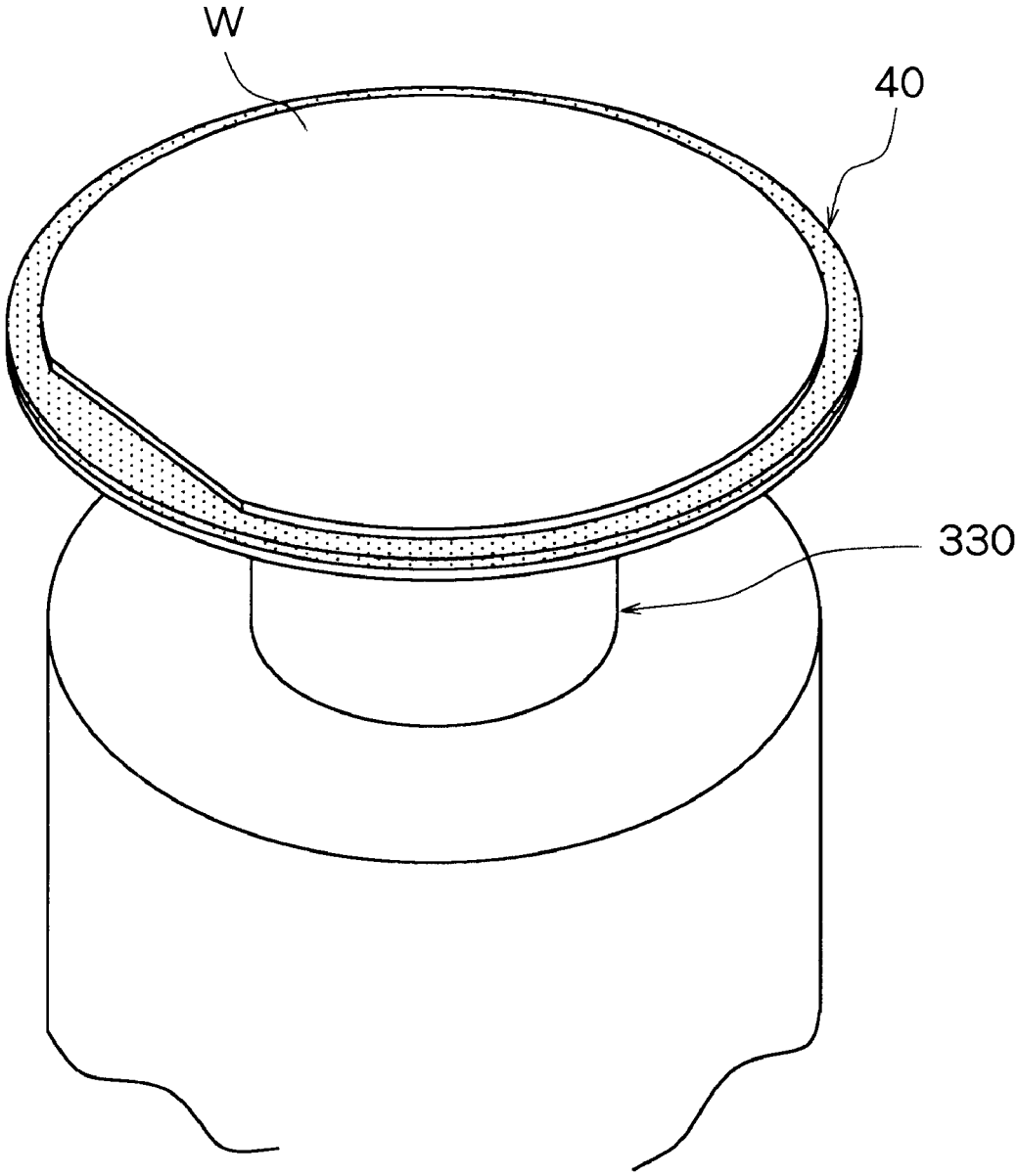
FIG. 6 is a perspective view of the wafer holding tray shown in FIG. 3 placed on the spinner table.

The chuck table 20 returned to the workpiece carrying-in/carrying-out area A via the rough-grinding area B and the finish-grinding area C releases the suction-holding of the finish ground semiconductor wafer W at this stage. Before the ground semiconductor wafer W whose suction-holding is released from the chuck table 20 returned to the workpiece carrying-in/carrying-out area A is carried to the cleaning means 33, the wafer holding tray 40 stored in the cassette 35 is carried and placed on the spinner table 330 of the cleaning means 33 by the vertical movement and horizontal movement of the workpiece carrying means 36 (holding tray setting step). When the wafer holding tray 40 is thus mounted on the spinner table 330, the workpiece take-out means 38 is activated to take out the ground semiconductor wafer W whose suction-holding is released from the chuck table 20 returned to the workpiece carrying-in/carrying-out area A from the chuck table 20 (wafer carrying-out step) and place it on the elastic pad of the wafer holding tray 40 placed upon the spinner table 330 (wafer placing step after processing). By activating the suction means (not shown) connected to the spinner table 330, the wafer holding tray 40 and the ground semiconductor wafer W are suction-held on the spinner table 330 as shown in FIG. 6 (ground wafer suction-holding step). That is, negative pressure generated by the function of the suction means (not shown) is applied to the under surface of the substrate 41 constituting the wafer holding tray 40 through the suction-holding chuck 332 formed of the porous ceramic board of the spinner table 330 to suction-hold the wafer holding tray 40 on the spinner table 330. When the above negative pressure is introduced through the communication holes 411 formed in the substrate 41, it is applied to the ground semiconductor wafer W placed on the top surface of the elastic pad 42 through the through holes 422 formed in the elastic pad 42 and the ground semiconductor wafer W is adsorbed to the elastic pad 42. When the wafer holding tray 40 and the ground semiconductor wafer W are thus suction-held on the spinner table 330, the cleaning means 33 is activated to clean the ground semiconductor wafer W (ground wafer cleaning step).

After the above-described ground wafer cleaning step is carried out, the operation of the suction means (not shown) connected to the spinner table 330 is stopped to release the suction-holding of the wafer holding tray 40 placed on the spinner table 330. When the operation of the suction means (not shown) is stopped, the introduction of negative pressure is released through the communication holes 411 formed in the substrate 41 of the wafer holding tray 40 but the wafer holding tray 40 keeps adsorbing the ground semiconductor wafer W as described above. That is, when the ground semiconductor wafer W is suction-held on the elastic pad 42 in the above ground wafer suction-holding step, the elastic pad 42 is compressed and the voids 421 formed in the surface 420 are crushed with the result that the semiconductor wafer W is kept adsorbed by the suction force of negative pressure produced in the voids 421 by restoring force generated by the elasticity of the elastic pad 42 and the adhesion of the elastic pad 42.

Thereafter, the ground semiconductor wafer W suction-held on the wafer holding tray 40 whose suction-holding is released from the spinner table 330 is carried to the cassette 34 and stored in the cassette 34 by the vertical movement and horizontal movement of the workpiece carrying means 36 (ground wafer storing step). Since the ground semiconductor wafer W is suction-held on the wafer holding tray 40 while it is carried by the workpiece carrying means 36, it is supported by the rigidity of the wafer holding tray 40 and does not bent even after it is made thin by grinding and divided into chips by so-called "pre-dicing". Therefore, it can be carried smoothly and can be easily stored in the cassette 34. Even when the ground semiconductor wafer W stored in the cassette 34 is to be carried to another production step, it can be carried smoothly as it is suction-held on the wafer holding tray 40 and is integrated as described above and supported by the rigidity of the wafer holding tray 40 so that it does not bend. To release the suction-holding of the ground semiconductor wafer W by the wafer holding tray 40, the substrate 41 of the wafer holding tray 40 is mounted to a pressurizing means (not shown) to supply high-pressure air into the communication holes 411 formed in the substrate 41. As a result, high-pressure air supplied into the communication holes 411 passes through the through holes 422 and enters the voids 421 to attenuate adsorbing force, thereby making it possible to remove the ground semiconductor wafer W from the wafer holding tray 40 easily.

Since the semiconductor wafer grinding method of the present invention is constituted as described above, it has the following function and effect.

That is, according to the present invention, since the method of the present invention comprises the step of holding the ground semiconductor wafer taken out from the chuck table by means of the wafer holding tray after grinding, even after the semiconductor wafer is made thin by grinding or divided into chips by so-called "pre-dicing", it is supported by the rigidity of the wafer holding tray so that it does not bend. Therefore, it can be carried smoothly and easily stored in the cassette for storing a ground wafer. Further, since the wafer holding tray does not exist between the chuck table and the semiconductor wafer at the time of grinding, excellent grinding accuracy can be ensured without causing a reduction in finishing accuracy.

What is claimed is:

1. A method of grinding a semiconductor wafer using a grinding machine having a chuck table for holding a semiconductor wafer and a grinding means for grinding the top surface of a semiconductor wafer held on the chuck table comprising:

the step of placing the semiconductor wafer to be ground on the chuck table;

the step of grinding the top surface of the semiconductor wafer placed on the chuck table to a predetermined thickness by means of the grinding means;

the step of carrying out the ground semiconductor wafer from the chuck table; and the step of holding the ground semiconductor wafer carried out from the chuck table by means of a wafer holding tray, wherein the wafer holding tray for holding the semiconductor wafer is constituted by an elastic pad which has innumerable voids formed in the surface and generates sucking force when negative pressure is produced by the voids crushed by restoring force generated by elasticity and adhesion, and a substrate mounting the elastic pad and having communication holes for introducing negative pressure or applied pressure force into the elastic pad; and the tray holding step is to place the semiconductor wafer carried out from the chuck table on the surface of the elastic pad of the wafer holding tray and introduce negative pressure into the communication holes to suction-hold the semiconductor wafer onto the elastic pad.

2. The semiconductor wafer grinding method of claim 1, wherein the grinding machine has a cleaning means having a spinner table for placing the ground semiconductor wafer and a tray cassette for storing the wafer holding tray; and the tray holding step includes the sub-step of carrying out the wafer holding tray stored in the tray cassette and placing it on the spinner table before the ground semiconductor wafer is placed on the spinner table, the sub-step of placing the ground semiconductor wafer on the elastic pad of the wafer holding tray placed on the spinner table, and the sub-step of introducing negative pressure into the communication holes formed in the substrate of the wafer holding tray placed on the spinner table to suction-hold the semiconductor wafer on the elastic pad.

3. The semiconductor wafer grinding method of claim 2, wherein the grinding machine comprises a cassette for storing a ground semiconductor wafer after cleaning; and the method further comprises the step of storing the semiconductor wafer integratedly held on the wafer holding tray in the cassette from the cleaning means after the semiconductor wafer is cleaned with the cleaning means.

* * * * *